US006942574B1

(12) United States Patent
LeMay et al.

(10) Patent No.: US 6,942,574 B1
(45) Date of Patent: Sep. 13, 2005

(54) METHOD AND APPARATUS FOR PROVIDING ENTERTAINMENT CONTENT ON A GAMING MACHINE

(75) Inventors: Steven G. LeMay, Reno, NV (US); James W. Stockdale, Clio, CA (US); Dwayne R. Nelson, Las Vegas, NV (US)

(73) Assignee: IGT, Reno, NV (US)

( * ) Notice: Subject to any disclaimer, the term of this patent is extended or adjusted under 35 U.S.C. 154(b) by 274 days.

(21) Appl. No.: 09/665,526

(22) Filed: Sep. 19, 2000

(51) Int. Cl.[7] ..... A63F 9/24
(52) U.S. Cl. ..... 463/41
(58) Field of Search ..... 273/142 K, 138.1, 273/143 R; 463/16, 20, 42

(56) References Cited

U.S. PATENT DOCUMENTS

| | | | | |
|---|---|---|---|---|
| 4,517,558 A | | 5/1985 | Davids | 340/700 |
| 4,712,799 A | * | 12/1987 | Fraley | 463/20 |
| 4,718,672 A | | 1/1988 | Okada | 273/143 |
| 4,824,121 A | | 4/1989 | Beall et al. | 273/376 |
| 4,991,848 A | | 2/1991 | Greenwood et al. | 273/143 |
| 5,127,651 A | | 7/1992 | Okada | 273/143 R |
| 5,178,390 A | | 1/1993 | Okada | 173/143 R |
| 5,259,613 A | * | 11/1993 | Marnell, II | 273/460 |
| 5,326,104 A | | 7/1994 | Pease et al. | 273/138 |
| 5,375,830 A | | 12/1994 | Takemoto et al. | 273/143 |
| 5,548,348 A | | 8/1996 | Kawabata | 348/766 |
| 5,560,603 A | | 10/1996 | Seelig et al. | 463/6 |
| 5,619,738 A | | 4/1997 | Petruchik et al. | 396/311 |
| 5,643,086 A | | 7/1997 | Alcorn et al. | 463/29 |
| 5,664,998 A | | 9/1997 | Seelig et al. | 463/20 |
| 5,697,843 A | | 12/1997 | Manship et al. | 463/70 |
| 5,722,891 A | | 3/1998 | Inoue | 463/20 |
| 5,761,647 A | | 6/1998 | Boushy | 705/10 |
| 5,788,573 A | | 8/1998 | Baerlocher et al. | 463/16 |
| 5,851,148 A | | 12/1998 | Brune et al. | 463/25 |
| 5,902,983 A | | 5/1999 | Crevelt et al. | 235/380 |
| 5,971,849 A | * | 10/1999 | Falciglia | 463/16 |
| 5,971,851 A | * | 10/1999 | Pascal et al. | 463/24 |

(Continued)

FOREIGN PATENT DOCUMENTS

| | | | |
|---|---|---|---|
| GB | 2072395 | 9/1981 | G07F/17/34 |
| GB | 2083936 | 3/1982 | G07F/17/34 |
| GB | 2 106 685 A | 4/1983 | G07F/17/34 |
| GB | 2 157 047 A | 10/1985 | G07F/17/34 |
| GB | 2 170 938 A | 8/1986 | G07F/17/34 |

(Continued)

OTHER PUBLICATIONS

Caraballo et al, The IRC Prelude, [http;//www.irchelp.org/irchelp/new2irc.html, Jun. 1, 2000].*

(Continued)

*Primary Examiner*—Jessica Harrison
*Assistant Examiner*—Corbett Coburn
(74) *Attorney, Agent, or Firm*—Beyer, Weaver & Thomas LLP

(57) ABSTRACT

A gaming machine with devices able to output entertainment content (e.g. movies, TV programming, audio programs and advertising) from entertainment content sources located within the gaming machine or outside of the gaming machine is described. A player utilizing the gaming machine may access, independently of game play, entertainment content on the gaming machine where access to the entertainment content is granted according to a predetermined fee. In addition, the player utilizing the gaming machine may receive personal messages on the gaming machine. For example, while utilizing the gaming machine, a player may receive, e-mail, stock quotes, news and advertising that is of particular interest to the player utilizing the gaming machine.

42 Claims, 6 Drawing Sheets

U.S. PATENT DOCUMENTS

| | | | | |
|---|---|---|---|---|
| 5,984,780 | A | 11/1999 | Takemoto et al. | 463/20 |
| 6,029,973 | A | 2/2000 | Takemoto | 463/13 |
| 6,039,648 | A | 3/2000 | Guinn et al. | 463/16 |
| 6,089,975 | A | 7/2000 | Dunn | 463/16 |
| 6,104,815 | A | 8/2000 | Alcorn et al. | 380/251 |
| 6,106,396 | A | 8/2000 | Alcorn et al. | 463/29 |
| 6,113,495 | A | 9/2000 | Walker et al. | 463/42 |
| 6,139,431 | A | 10/2000 | Walker et al. | 463/20 |
| 6,149,522 | A | 11/2000 | Alcorn et al. | 463/29 |
| 6,226,589 | B1 * | 5/2001 | Maeda et al. | 701/207 |
| 6,234,896 | B1 | 5/2001 | Walker et al. | 463/16 |
| 6,270,411 | B1 * | 8/2001 | Gura et al. | 463/20 |
| 6,302,790 | B1 * | 10/2001 | Brossard | 273/143 R |
| 6,379,246 | B1 * | 4/2002 | Dabrowski | 463/16 |
| 6,640,184 | B1 * | 10/2003 | Rabe | 701/207 |
| 2001/0011954 | A1 * | 8/2001 | Shelton et al. | 340/825.49 |

FOREIGN PATENT DOCUMENTS

| | | | |
|---|---|---|---|
| GB | 2 181 589 | 4/1987 | G07F/17/34 |
| GB | 2182186 | 5/1987 | G07F/17/34 |
| GB | 2 254 469 A | 7/1992 | G07F/17/34 |
| GB | 2 262 642 | 6/1993 | G07F/17/34 |
| GB | 1 494 368 | 7/1997 | A63F/9/00 |
| GB | 2 192 478 A | 1/1998 | G07F/17/34 |
| JP | 55-80980 | 11/1978 | |
| JP | 63-24970 | 2/1988 | A63F/7/02 |
| JP | 64-58287 | 3/1989 | A63F/9/22 |
| JP | 4-183484 | 6/1992 | A63F/5/04 |
| JP | 6-7498 | 1/1994 | A63F/5/04 |
| JP | 6-35066 | 2/1994 | G03B/21/10 |
| JP | 6-63247 | 3/1994 | A63F/9/22 |
| JP | 8-304911 | 11/1996 | G03B/17/24 |
| WO | WO/9847115 | 10/1998 | G07F/17/34 |

OTHER PUBLICATIONS

Yahoo Internet Site for Nov. 14, 1999, [http:///web.archive.org/web/19991114233817/http://www.yahoo.com/index.html].*

Marshall Fey, Slot Machines, A Pictorial History of the First 100 Years, 1983, Liberty Belle Books, 87, 158–59.*

Microsoft Windows 3.1, 1992, Microsoft Press, pp. 3–17.*

Baerlocher, Anthony J., Bittman, Robert A., Brossard, Jean M., entitled "Gaming Machines Providing Bonus Games", U.S. Appl. No. 08/911,254, filed Aug. 8, 1997.

* cited by examiner

METHOD AND APPARATUS FOR PROVIDING ENTERTAINMENT CONTENT ON A GAMING MACHINE

BACKGROUND OF THE INVENTION

This invention relates to entertainment content for gaming machines such as slot machines and video poker machines. More particularly, the present invention relates to methods of providing entertainment content to a player playing a game on the gaming machine.

As technology in the gaming industry progresses, the traditional mechanically driven reel slot machines are being replaced with electronic counterparts having CRT, LCD video displays or the like. These video/electronic gaming advancements enable the operation of more complex games, which would not otherwise be possible on mechanical-driven gaming machines. Gaming machines such as slot machines and video poker machines are becoming increasingly popular. Part of the reason for their increased popularity is the nearly endless variety of games that can be implemented on gaming machines utilizing advanced electronic technology.

There are a wide variety of associated devices that can be connected to a gaming machine such as a slot machine or video poker machine. Some examples of these devices are lights, ticket printers, card readers, speakers, bill validators, ticket readers, coin acceptors, display panels, key pads, coin hoppers and button pads. Many of these devices are built into the gaming machine or components associated with the gaming machine such as a top box which usually sits on top of the gaming machine.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including key pads and button pads, to determine the wager amount and initiate game play. After game play has been initiated, the gaming machine determines a game outcome, presents the game outcome to the player and may dispense an award of some type depending on the outcome of the game.

For gaming machine operators, an important aspect of operating a gaming machine is determining the game playing habits of individual game players. When the game playing habits of an individual player are known, the gaming machine operator may provide incentives corresponding to the game playing habits of the individual game player to encourage additional game play. For example, the gaming machine operator may provide an individual player with coupons for free meals, free rooms or discounted game play depending on their game playing habits.

Typically, on a casino floor with many gaming machines as players leave and enter the gaming area, many gaming machines remain idle while other gaming machines are being utilized by players playing games. When idle, a gaming machine does not generate revenue for the owner of the gaming machine. Thus, gaming hardware or methods that 1) encourage additional game play on a gaming machine or 2) generate revenue independent of the game play on a gaming machine, are always sought after by gaming machine operators. In addition, the hardware or methods may not be related to the game play. For example, for gaming machines with an electronic video display screen, showing advertisements has been proposed as a means of generating additional revenue when the gaming machine is not in use.

In view of the above, using the advanced technology of current gaming machines, it would be desirable to provide method and apparatus that 1) generate revenue when the gaming machine is not being used for game play and 2) encourage additional game play on the gaming machine.

SUMMARY OF THE INVENTION

This invention addresses the needs indicated above by providing a gaming machine able to output entertainment content (e.g. movies, TV programming, audio programs and advertising) from entertainment content sources located within the gaming machine or outside of the gaming machine. A player utilizing the gaming machine may access, independently of game play, entertainment content on the gaming machine where access to the entertainment content is granted according to a predetermined fee. In addition, the player utilizing the gaming machine may receive personal messages on the gaming machine. For example, while utilizing the gaming machine, a player may receive, e-mail, stock quotes, news and that is of particular interest to the player on the gaming machine.

One aspect of the present invention provides a gaming machine with access to entertainment content sources. The gaming machine may be characterized as including the following elements: 1) a display device, 2) a master gaming controller that controls one or more games played on the gaming machine and presents a game outcome presentation on said display device, 3) at least one input device for selecting the entertainment content source, and 4) at least one output device configured to output entertainment content from the selected entertainment content source, wherein the entertainment content is independent of the game outcome presentation presented on the gaming machine. The games played on the gaming machine may include a video slot game, a mechanical slot game, a video pachinko game, a video poker game or a keno game.

In specific embodiments, the output device may include a sound projection device, a monitor, an LCD, a fluorescent display, a pair of headphones, or a head-mounted video display. The entertainment content source may include a CD player, an FM/AM tuner, a VHS player, a DVD player, a TV tuner, a musical jukebox, a video jukebox, a computer, a server, or a media software application. The input device may include at least one of a key pad, a touch screen, a mouse, a joystick and input button and a track ball. The entertainment content may include, an advertisement, news, stock quotes, electronic mail, a web page, a message service, a locator service and a hotel/casino service, a movie, a musical selection or a broadcast event.

In other embodiments, the entertainment content is accessible when a game play is initiated on the gaming machine. The access to the entertainment content may be time dependent upon an indicia of credit amount, a wager amount, or a game playing history. Alternatively, the entertainment content may be provided according to a player information profile. The entertainment content may be displayed on the display device while the game outcome presentation is displayed on the display device or the entertainment content may displayed on the output device while the game outcome presentation is displayed on the display device. Further, the input device may be used to control a feature of the entertainment content.

Another aspect of the present invention enables a method of providing entertainment content on a gaming machine providing game outcome presentations for one or more games. The method may be characterized as including: 1) displaying a list of one or more entertainment content sources, 2) receiving a selection of the entertainment content source from said list and 3) outputting the entertainment content from the selected entertainment content source to an output device, where the entertainment content is independent of the game outcome presentation for the one or more games. Additionally, the method may include, a) prior to outputting the entertainment content, determining an indicia of credit amount for the selected entertainment content source, b) displaying a message on the display device notifying a player of the required indicia of credit amount and c) initiating the selected entertainment content when the required indicia of credit amount is available on the gaming machine or i) prior to receiving the selection, receiving player tracking information and ii) allowing access to the entertainment content sources based upon the player tracking information.

In more specific embodiments, the method may include a) determining a total access time to the entertainment content source based upon player tracking information, a wager amount on a game or a indicia of credit amount deposited into the gaming machine and b) comparing an access time to the entertainment source to the total access time and terminating access to the entertainment content source when the access time exceeds the total access time. Further the method may include, a) prior to displaying the list of entertainment content sources, loading information enabling the entertainment content to the entertainment content sources or b) displaying entertainment content on the output device while displaying the game outcome presentation on a display device where the output device and the display device are the same device.

Another aspect of the present inventions provides a method for sending a personal message to a player playing a game on a gaming machine. The method may be generally characterized as including: a) receiving player identification information from the player playing the game on the gaming machine, b) sending the player identification information to a server wherein the server assigns an communication identifier to the gaming machine, c) receiving a personal message from at least one information source located outside the game machine for the player playing the game on the gaming machine identified by the player identification information and d) outputting the personal message for the player playing the game on the gaming machine to an output device. The player identification information may be player tracking information and the gaming machine communication identifier may be an IP address. The personal message may be from another player, a hotel employee or a casino employee. Additionally, the personal message may be selected according to a player profile for the player playing the game on the gaming machine where the personal message is stock quotes, news, prize information, or advertisements of interest to the player playing the game on the gaming machine.

These and other features of the present invention will be presented in more detail in the following detailed description of the invention and the associated figures.

DESCRIPTION OF THE PREFERRED EMBODIMENTS

Figure 1:
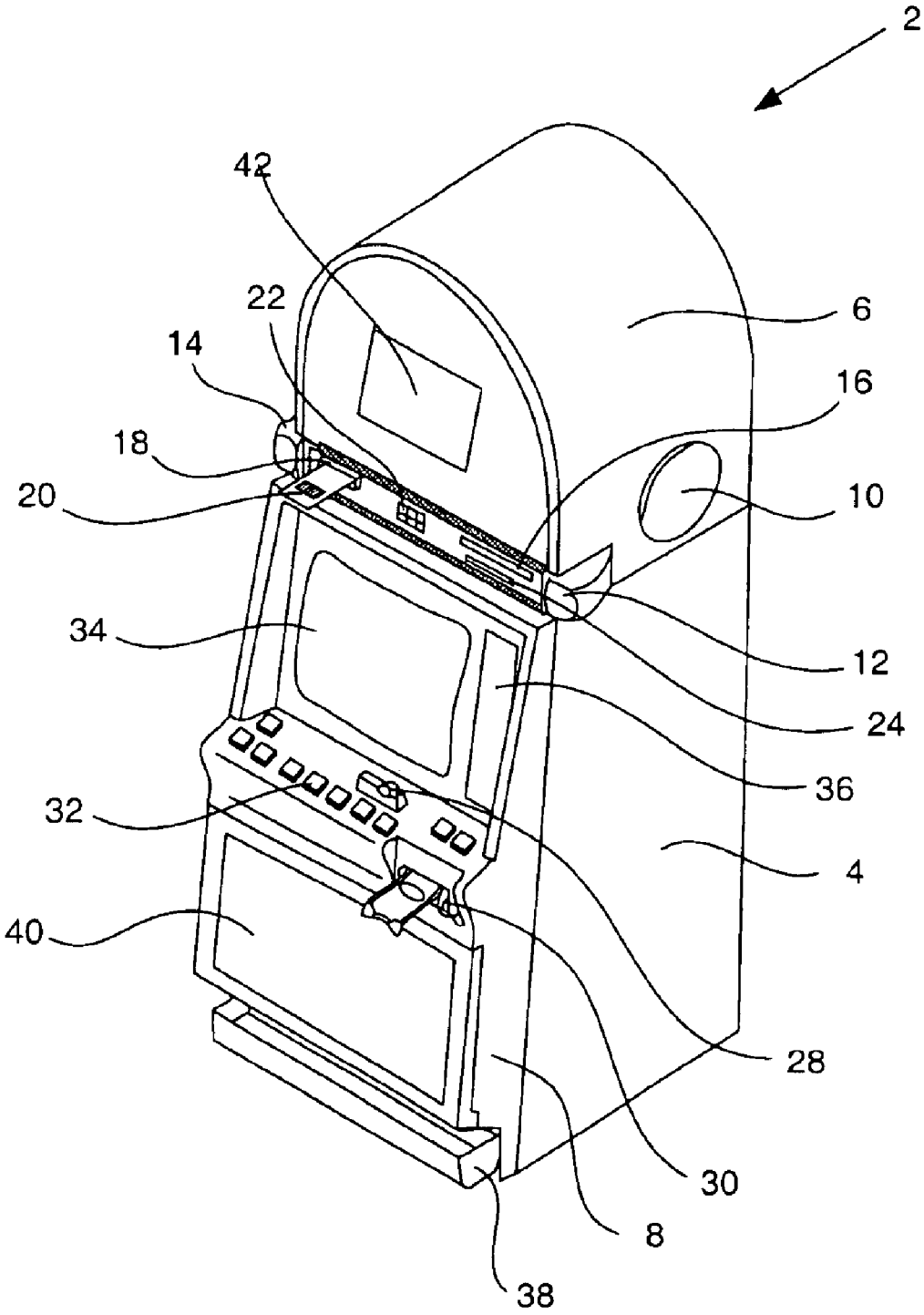
FIG. 1 is a perspective drawing of a gaming machine for one embodiment of this invention.

Turning first to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The main display monitor 34 will typically be a cathode ray tube, high resolution flat-panel LCD, or other conventional electronically controlled video monitor. The gaming machine 2 includes a top box 6, which sits on top of the main cabinet 4. A second display monitor 42 may be provided in the top box. The second display monitor may also be a cathode ray tube, high resolution flat-panel LCD or other conventional electronically controlled video monitor.

Figure 3:
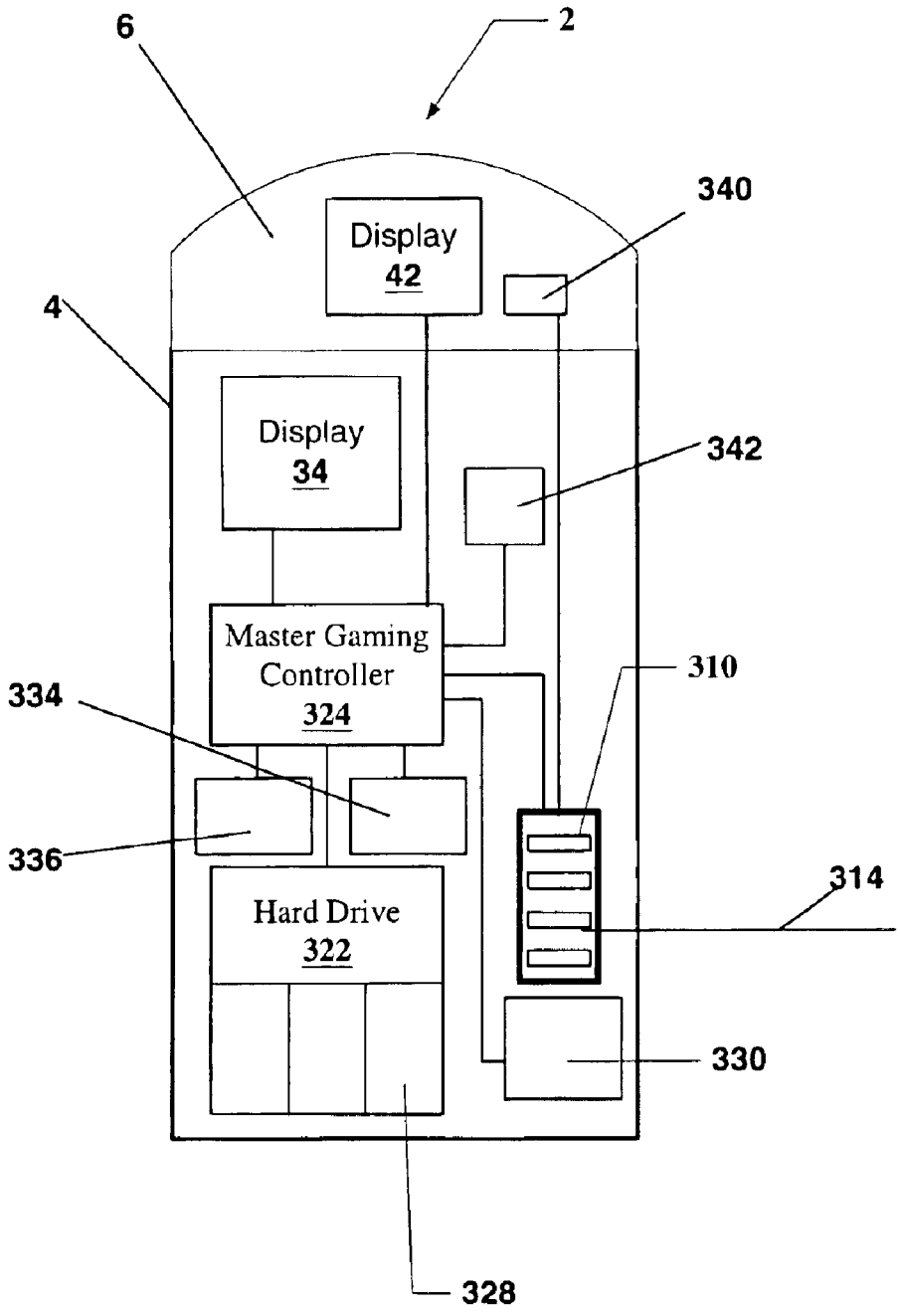
FIG. 3 is a block diagram of the inside of a gaming machine having a top box and other devices.

Typically, after a player has initiated a game on the gaming machine, one purpose of the main display monitor 34 and the second display monitor 42 is the visual display of a game outcome presentation, including bonus games, controlled by a master gaming controller 324 (FIG. 3). Also, the main display monitor 34 and the second display monitor 42 may also be utilized to display entertainment content independent of the game outcome presentation. For example, broadcast events, including television programming, may be provided to the main display monitor 34 and the secondary display monitor 42 via a cable link or other suitable link from outside of the gaming machine. All or some subset of the programming provided by a television broadcaster may be displayed as entertainment content on one or both of the video displays. Television programming content of particular interest to casino operators and game players may include, for example, sporting events, talk shows, game shows, soap operas, advertisements, situation comedies, etc. In addition, broadcasts of competitive events on which the player can wager may be displayed. For example, dog racing or horse racing events may be displayed as content on the video display. In such events, there is typically a rather long down time between races. During this period, the player may play the gaming machine. Then, when a race begins, the player focuses his or her attention on that event without needing to leave his position at the gaming machine. Also, the television programming entertainment content may be displayed while a player is engaged in playing a game on the gaming machine or between games. Similarly, the entertainment content may include information available on the Internet, including the World Wide Web, for more technologically sophisticated players.

Returning to the gaming machine in FIG. 1, the information panel 36 may be a back-lit, silk screened glass panel with lettering to indicate general game information including, for example, the number of coins played. The bill validator 30, player-input switches 32, video display monitor 34, and information panel are devices used to play a game on the game machine 2. The devices are controlled by the master gaming controller, housed inside the main cabinet 4 of the machine 2. Many possible games, including traditional mechanical slot games, video slot games, video poker, video pachinko and keno, may be provided with gaming machines of this invention.

The top box 6 houses a number of devices, which may be used to add features to a game being played on the gaming machine 2, including speakers 10, 12, 14, a ticket printer 18 which prints bar-coded tickets 20, a key pad 22, a florescent display 16 and a card reader 24 for entering a magnetic striped cards. The speakers may be used to project sound effects as part of a game outcome presentation. The key pad 22, the florescent display 16 and the card reader 24 may be used for to enter and display player tracking information. As another example, the player may enter playing tracking information and identification information using the card reader 24 and the main video display 34 where the main video display may be used as a touch screen to enter information. Player tracking information may be entered into the gaming machine before a player initiates a game on the gaming machine. Typically, the player's incentive to enter player tracking information into the gaming machine 2 is potential rewards related to the amount of a player's game play.

In addition to enabling player tracking services, the key pad 22, the florescent display 16 and the card reader 24 may be used to enter identification information that enables a player to access entertainment content or receive personal messages on the gaming machine independent of a game play and game outcome presentation on the gaming machine 2. For example, a player may enter a personal identification number into the gaming machine 2 using the key pad 22 that allows the player to receive entertainment content such as viewing a movie or a broadcast event. As another example, after entering the personal identification number, the player may be allowed to receive a personal message indicating a table is ready at a restaurant in the casino or to receive a personal message containing information on a sporting event such as a score of personal interest to the player utilizing the gaming machine.

The identification information may be separate from the player tracking information, may be ascertained from the player tracking information or may be in addition to the player tracking information entered into a gaming machine by the player utilizing a gaming machine. For example, the player may utilize an identification number as the identification information that is independent of any player tracking information entered into the gaming machine. The identification number may allow a player to receive a particular personal message (e.g. a dinner reservation is ready) or a number of personal messages during a certain time period.

In addition to the devices described above, the top box 6 may contain different or additional devices than shown in the FIG. 1. For example, the top box may contain a bonus wheel or a back-lit silk screened panel which may be used to add bonus features to the game being played on the gaming machine. During a game, these devices are controlled and powered, in part, by circuitry (not shown) housed within the main cabinet 4 of the machine 2. Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video, while others are designed for bar tables and have displays that face upwards. Those of skill in the art will understand that the present invention, as described below, can be deployed on most any gaming machine now available or hereafter developed.

Returning to the example of FIG. 1, when a user selects a gaming machine 2, he or she inserts cash through the coin acceptor 28 or bill validator 30. Additionally, the bill validator may accept a printed ticket voucher which may be accepted by the bill validator 30 as an indicia of credit. Once cash has been excepted by the gaming machine, it may be used to play a game on the gaming machine. Typically, the player may use all or part of the cash entered into the gaming machine to make a wager on a game play. Depending on the amount of the wager on a game or for a fee, a player may be able to access various entertainment content sources for a length of time. For example, a wager on a game above a certain threshold amount may enable a player to watch a broadcast event or to access the World Wide Web for up to 5 minutes on the gaming machine 2. In addition, cash or indicia of credit entered into the gaming machine may be used to purchase entertainment content independent of a wager made on a game on the gaming machine. For example, for a 10 dollar fee, a player may view a movie on the gaming machine. While watching the movie on the gaming machine, the player may play games on the gaming machine or just watch the movie.

During the course of a game, a player may be required to make a number of decisions which affect the outcome of the game. For example, a player may vary his or her wager, select a prize, or make game-time decisions which affect the game play. These choices may be selected using the player-input switches 32, the main video display screen 34 or using some other device which enables a player to input information into the gaming machine including a key pad, a touch screen, a mouse, a joy stick, a microphone and a track ball.

When a game is not being played on the gaming machine or during particular game operational modes, the player may select an entertainment content source using the above mentioned inputs where the entertainment content is independent of a game being played on the gaming machine. The entertainment content source may include, for instance, a CD player, an FM/AM tuner, a VHS player, a DVD player, a TV tuner, a musical jukebox, a video jukebox, a computer, a server and a media software application. It will be appreciated, however, that any information source may be utilized.

Before playing a game, a player may select the video jukebox, which may contain a DVD player loaded with many DVDs, as the entertainment content source and preview a movie on at least one of the display screens on the gaming machine 2. The DVDs may be stored on the gaming machine 2 or in a central location separate from the gaming machine. The visual display of the output from the video jukebox may be viewed by the player on the main video display screen 34 or the secondary video display-screen 42. The sound for the movie may be projected by the speakers 10, 12 and 14 on the gaming machine or a player may listen to the movie through headphones. The entertainment content received on the headphones may also be enabled through a wireless or wired communication interface to the gaming machine or some other device located within the casino.

The game player may also use the player input switches 32, key pad 22, and other input devices to control a feature of the entertainment content. For example, when the entertainment content is a movie, the player input switches 32 and key pad may be operated to fast forward, stop or pause the movie. When the entertainment content is accessing the World Wide Web through a web-browser, the player input switches 32 and key pad may be used to operate the web-browser.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. In some embodiments, the tickets may be used by a game player to obtain entertainment content. A ticket, for instance, may be printed with a "free movie" that allows a player to access a movie from the gaming machine that printed the ticket or another gaming machine.

Some advantages of providing gaming machines with the entertainment content choices described above are 1) increasing a player's interest in utilizing a gaming machine for longer periods of time and 2) providing more revenue generating uses for the gaming machine. Both of these advantages increase the potential profits which may be obtained from a gaming machine. In addition, any entertainment content services which attract a player to utilize a gaming machine, even activities that do not directly involve game playing, may indirectly increase gaming machine revenues because once a player is utilizing a gaming machine for any function the probability that a game playing session or other revenue generating activity will be initiated on the gaming machine is greatly increased.

Figure 2:
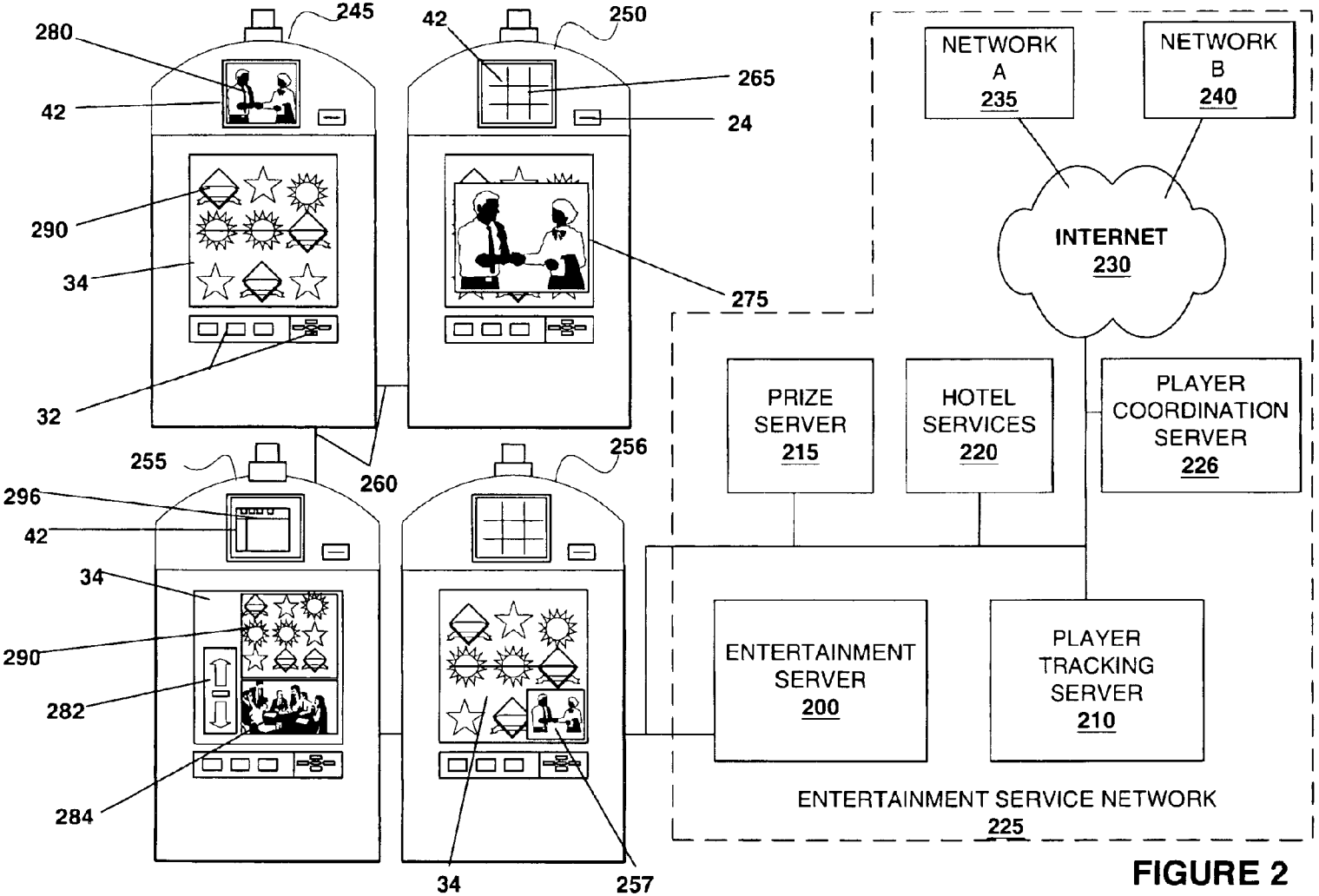
FIG. 2 is a block diagram of a gaming machines connected to an entertainment content network.

FIG. 2 is a block diagram of a plurality of gaming machines, 245, 250 and 255, connected to an entertainment content network 225. Gaming machines 245, 250 and 255 are connected in a gaming machine loop 260 on a casino floor. The gaming machine loop 260 may be a series of fiber optic connections between the gaming machines or some other wire or wireless connection scheme. These gaming machines may be physically proximate to one another on the casino floor or spread out over the casino floor.

Gaming machines 245, 250, 255 and 256 are illustrated with different combinations of entertainment content and game presentations on the main video display screen 34 and secondary video display screen 42. For example, on gaming machine 245, a game presentation 290 is displayed on the main display screen 34 and advertising entertainment content 280 is displayed on the secondary display 42. In another embodiment, a picture in a picture display 257 is implemented on the main display screen 34 on gaming machine 256. As described with reference to FIG. 1, a player may operate the input switches 32 to make game decisions and adjust features of the entertainment content.

On gaming machine 250, a content list 265 of entertainment content sources is displayed on the secondary video screen 42 while a movie is displayed on the main display screen 34. In one embodiment, the content list 265 of entertainment content sources may include devices or software such as a CD player, an FM/AM tuner, a VHS player, a DVD player, a TV tuner, a musical jukebox, a video jukebox, a computer, a server and a media software application. The entertainment content source may be located physically within the gaming machine or at a location outside of the gaming machine but in communication with the gaming machine.

The content list 265 may be presented as a series of menus. For example, after selecting the DVD player as the entertainment content source from the content list 265, the content list 265 may display a list of DVD titles, which the player may select for viewing on the gaming machine. Further, the entertainment content list 265 may be personalized to the individual player. The entertainment content list, for instance, may display DVD titles that are of particular interest to a game player.

In general, the entertainment content source may be any device capable of delivering entertainment content to the gaming machine. The entertainment content source may be adapted for use by a gaming machine and may operate only during selected operational modes of the gaming machine. By way of example, when the DVD player is utilized by the gaming machine as an entertainment content source, the DVD player may be adapted to respond to input signals from the gaming machine such as pause or stop. The input signals to the DVD player may be initiated by the master gaming controller on the gaming machine independently of player input or in response to player input. When a gaming machine is not used for a certain period of time, for example, the master gaming controller may transmit signals to the DVD player to obtain output signals for at least one of the video display screens on the gaming machine.

To access an entertainment content source on the gaming machines 245, 250 255 and 256, a player may be required to input an indicia of credit amount for the selected entertainment content source or commit an indicia of credit already available on the gaming machine. The gaming machine may notify the player of the required amount by displaying a message of some type to the player. For example, after a player has selected a video jukebox as the entertainment source, the gaming machine may display a message such as "please deposit 5 credits" or "the selected entertainment content source requires 5 credits, hit button A to commit this amount." The entertainment content source will then be initiated when the required finds have been made available to the gaming machine. In this manner, a player may access an entertainment content source without initiating game play on the gaming machine i.e. by making a wager on a game.

In other embodiments, the entertainment content source may be accessed according to; 1) a wager amount made on a single game play (as described above); 2) an average wager amount over a period of time made by the player, and 3) a game playing history of the player obtained from player tracking information or some other source. For instance, after entering player tracking information on the gaming machine, a player that has wagered a certain amount over a certain period of time may be granted free access to an entertainment content source such as the musical jukebox. In another example, a player may only access certain entertainment content sources based upon their player tracking information i.e. only a player with a particular game playing history may be able to access electronic e-mail on the gaming machine.

For each of the access modes to the entertainment content sources described above (e.g. inserting a required amount of indicia of credit into the gaming machine to access the entertainment content source, making a wager of a certain amount or a game playing history obtained from player tracking information), a total access time to the entertainment content source may be determined by the master gaming controller on the gaming machine. A table may be stored in internal memory on the gaming machine relating: 1) the required indicia of credit amount or fee; 2) the amount of a wager made on a game play; and 3) a game playing history events versus access to a particular entertainment content source for an amount of time (e.g. total access time). For example, for 2 credits, a player may access an in-house TV programming source for 5 minutes. For a wager of 5 credits on a game play, the player may access the in-house TV programming source for 5 minutes. For wagering 100 credits over a period of 3 hours, the player may access the in-house TV programming source for 5 minutes. After access to an entertainment content source has been initiated and a total access time has been determined, the master gaming controller may monitor the amount of time the entertainment content source has been accessed against the determined total access time. When the amount of time the entertainment content source has been accessed exceeds the granted total access time, access to the entertainment content source may be terminated unless a player performs another operation such as committing more credits on the gaming machine towards access to the entertainment content source.

After receiving an entertainment source selection satisfying the predetermined conditions required to access the entertainment content source and determining a total access time to the entertainment content source, the entertainment content is transmitted to an output device on the gaming machine. For example, upon receiving a selection of a movie title by a player, the DVD player may transmit video signals to one of the display screens on the gaming machine or to a head mounted display worn by the player. The corresponding audio signals from the DVD player may be sent to speakers on the gaming machine or to headphones worn by the player. Typically, the output from the entertainment content source may not depend on the game play on the gaming machine e.g. game play decisions made by the player while playing the gaming machine may not affect output from the entertainment content source.

On the gaming machine 250, the movie display 275, displayed on the main video display screen 34, occupies nearly the entire screen. In this embodiment, the player at the gaming machine may be only viewing a movie and not engaged in any game play. In another example, the player may be previewing movies, which may be elected as a prize for the game played on the gaming machine 255. Thus, after previewing the movies, the player may engage in game play. In general, the gaming features and entertainment content features available on gaming machines allow many different sequences of game play and entertainment content utilization by the player. Game play and entertainment content utilization by the player may occur in a simultaneous manner or in a sequential.

Referring now to gaming machine 255, a web browser 296 connected to the World Wide Web or some other information network is displayed on the secondary display screen 42. As an example, the web browser may be used to obtain information from the World Wide Web, receive electronic mail or perform other information services available through the Internet, Intranet or other network. The main display screen 34 may be a split window of three parts: 1) a game presentation 290; 2) a broadcast event 284 i.e. Entertainment content; and 3) touch screen controls 282. The game presentation 290 may be used to play a game on the gaming machine where the touch screen controls 282 and the input switches 32 are used to control game inputs. The broadcast event 284 may be television programming or a sporting event. The television programming or the sporting event may be obtained from sources generally available to the public (e.g. broadcast events) or may be in-house or special programming (e.g. pay per view). The mechanisms for supplying the entertainment content to the gaming machine 255 are described in more detail with respect to FIG. 3.

For World Wide Web and electronic mail applications as describe above where the gaming machine may be connected to some entity via the Internet 230 or some other network, access to the gaming machine may be limited by an internal firewall within the gaming machine. The internal firewall may be hardware, software or combinations of both that prevent illegal access of the gaming machine by an outside entity connected to the gaming machine. For instance, an illegal access may be an attempt to plant a program in the gaming machine that alters the operation of the gaming machine from a World Wide Web site. The internal firewall is designed to prevent someone such as a hacker from gaining illegal access to the gaming machine and tampering with it in some manner. The gaming machines 245, 250, 255 and 260 may contain internal firewalls.

The touch screen controls 282 and input switches 32 may be used to operate features of the entertainment content or perform game play on the gaming machine. For example, the touch screen controls 282 may be used to utilize features of the web browser 296, to change the television programming content (e.g. change channels) or to initiate game play on the gaming machine. The displayed features of the touch screen controls 282 may change according to what features of the entertainment content or the gaming machine are being utilized. For instance, when television programming is being viewed on the display screen, then features that allow a player to adjust the volume or change the channel may be displayed on the touch screen. When a movie or a musical selection is being displayed on the display screen, then features that enable a player to adjust the volume, change the channel, forward, reverse, stop or pause may be displayed on the display screen. When a player utilizes the touch screen controls 282 or the input switches 32, input signals indicating a particular operation are sent to the master gaming controller within the gaming machine and the operation may be performed. For example, when a player hits a button to fast forward a movie, then the gaming machine directs the entertainment content source (i.e. DVD player) to perform the operation.

As previously mentioned, the gaming machines 245, 250, 255 are connected to an entertainment service network 225 and may communicate with other devices on this network. This entertainment service network 225 may offer entertainment content and other services to connected gaining. The network may utilize any suitable protocol or group of protocols such as USB, Ethernet, TCP/IP and the like for intercommunication. Examples of devices that may reside on this network include an entertainment server 200 containing entertainment content sources (e.g. a CD player, an FM/AM tuner, a VHS player, a DVD player, a TV tuner, a musical jukebox, a video jukebox, a computer, a server, a media software applications and the like), a prize server 215, a casino services server 220, a player tracking server 210, and a player coordination server 226.

The entertainment service network 225 may be comprised of fiber optic connections, copper Ethernet connections, wire-less connections or any combinations thereof of the three types of connections. The entertainment service network 225 may be a local area network usually located within one location such as a casino including a casino area network, a bonus game network, or a cashless system network. In addition, the entertainment service network 225 may be connected to a wide area network connecting many physical locations such as a wide area progressive network or the Internet 230. Network A 235 and Network B 240 are examples of wide area networks or other entertainment service networks which may be connected to the entertainment service network 225 via the Internet 230 or some other like network connection scheme. For example, Network A 235 may be a wide area progressive network and Network B 240 may be an entertainment service network at another casino.

In one embodiment of the present invention, after a player enters player tracking information (e.g. using the card reader 24 or some other input device) and the player tracking information is sent to the player tracking server 210, the player tracking server 210 may examine a player's information profile stored on the player tracking server 210. The information profile may contain information regarding a player's past game playing habits and past entertainment content utilization. Applying software that evaluates the information profile, the player tracking server 210 may transmit instructions to the gaming machine to display entertainment content of particular interest to a game player playing a game on the gaming machine. For example, the gaming machine may display advertisements, news, stock quotes, electronic mail messages, movie selections, musical selections and broadcast events of interest to the player playing the game on the gaming machine. By personalizing the messages sent to a player playing a game on the gaming machine, the player may be encouraged to increase the amount of their game play on the gaming machine.

In general, personalized entertainment content, personalized messages and personalized services on a gaming machine may be implemented without the player tracking server 210. As described with reference to FIG. 1, a player may enter identification information on the gaming machine. The identification information may be independent of the player tracking information or share elements of the player tracking information. After the gaming machine receives the identification information, the gaming machine may send the identification information to a server including the player coordination server 226. The player coordination server may assign a communication identifier to the gaming machine. For example, when the player coordination server 226 and the gaming machines 245, 250 and 255 use a TCP/IP communication protocol, the gaming machines may be assigned an IP address when a player enters identification information into the gaming machine.

Using the IP address and an appropriate communication protocol, personal messages may be sent to a gaming machine from different information sources located outside the gaming machine for a particular player playing utilizing the gaming machine. A restaurant employee (e.g. the information source), for example, may send a personal message in the form of e-mail or some other electronic message to a player playing a game on the a gaming machine indicating a dinner reservation is ready. The process may include: 1) a restaurant employee typing a message indicating the reservation is ready into a computer; 2) the computer sending the message to the casino services server 220; 3) the casino service server 220 sending a message to the player coordination server 226 requesting the IP address of the gaming machine or other communication identifier of the gaming machine where the player is located; 4) the player coordination server 226 establishing a communication link between the casino server and the gaming machine including 245, 250 and 255; and 5) the casino server 220 sending a message to one of the gaming machines 245, 250, and 255. In addition, advertisements or news of particular interest to a player based on a player's information profile stored on the player coordination server 226 may be sent to the player. In this example, the player coordination server 226 essentially functions as a message router. Message routing technology that may perform some of these functions is available from CISCO Technologies, San Jose, Calif.

In other embodiments, voice messages or electronic messages may be sent to a first player on a gaming machine from a hotel/casino employee performing a hotel/casino service and from a second player on a different gaming machine attempting to locate or communicate with the first player. The voice messages may be implemented using a Voice over IP technology available from CISCO Technologies, San Jose, Calif. In addition, a player on the gaming machines may receive the personal message from an entertainment content source being utilized as the information source. For example, the information source may be selected from the group consisting of the CD player, the FM/AM tuner, the VHS player, the DVD player, the TV tuner, the musical jukebox, the video jukebox, the computer, the server or the media software application. The entertainment content from the information source may be personalized to sustain the player's interest in utilizing the gaming machine. For instance, musical selections from a musical jukebox may be sent to the gaming machine based upon a player profile stored within the player coordination server 226 or targeted advertising, which may only be of interest to select players, may be sent to a select player based upon their player profile stored within the player coordination server 226.

After the gaming machine receives the personal message from the information source, the gaming machine outputs the personal message to an output device appropriate for the message. For example, an electronic mail messages, stock quotes, news, prize information or advertisements of interest to the player playing the game on the gaming machine may be displayed on the monitor, the LCD, the florescent display on the gaming machine. In addition, these visual messages may be output to a personal digital assistant, a pager, cell phone or the head-mounted video display carried or worn by the player. An audio message for the player may be output to a sound projection device on the gaming machine, headphones worn by the player or a cell phone carried by the player.

FIG. 3 is a block diagram of a gaming machine having a top box 6 and other internal components. As described with reference to FIG. 1, the gaming machine 2 includes a main cabinet 4 and the top box 6 located on top of the main cabinet. The secondary display 42, the main display 34, audio signal processor 334, a video signal processor 336, hard drive 332, audio/video output 342, CD-DVD drive 330 and main communication board 310 are connected to the master gaming controller 324. The master gaming controller 324 controls the presentation of games on the gaming machine and may control the operation of entertainment content sources connected to the gaming machine.

The audio signal processor 334 and the video signal processors 336 may be media software applications designed to process digital signals stored on the hard drive 332 or received from the CD-DVD drive 330. For example, the entertainment partition 328 of the hard drive may contain audio files stored in an MP-3 format or video files stored in an MPEG format. The audio signal processor 334 and video signal processor 336 may be media software applications residing in memory accessible to the master gaming controller 324. Examples of media software applications may include audio players, image viewers, movie players and a web browser. Typically, the audio processors and video signal processor include a number of hardware components. A more complete discussion of the use of hardware components used for multimedia application on a gaming machine is provided in commonly assigned, copending U.S. patent application Ser. No. 08/911,254 entitled GAMING MACHINES PROVIDING BONUS GAMES filed Aug. 8, 1997, the entire specification of which is incorporated herein by reference.

The media software applications may operate on the audio and video files stored on the hard drive enabling video or audio signals to be output to an output device on the gaming machine. In addition, the audio signals and video signals may be output to the output devices residing outside of the gaming machine via the audio/visual output 342. For example, a headphone jack allowing a player to plug in a set of headphones into gaming machine may be one component of the audio/visual output 342. As another example, the audio/visual output may contain a wireless interface allowing the gaming machine to communicate with output devices not physically connected to the gaming machine including pagers, cell phones and personal digital assistants.

The audio and video files may be down-loaded to the gaming machine via the CD-DVD drive 330 and stored in the entertainment partition of the hard drive 322. In addition audio/video files or feeds (e.g. a television program feed containing various audio/video signals) may be sent to the gaming machine 2 via the remote feed 314 and the main communication board 310 connected to the master gaming controller. The audio and the video signals may be processed by the audio signal processor 334 and the video signal processor 336. For example, the entertainment server, as described with reference to FIG. 2, may contain the video jukebox, the audio jukebox, and the television programming that is accessible to the gaming machine 2 over the entertainment service network. A player utilizing the gaming machine may make selections from the video jukebox and the audio jukebox on the entertainment server from a list of selections displayed on the gaming machine.

Figure 4:
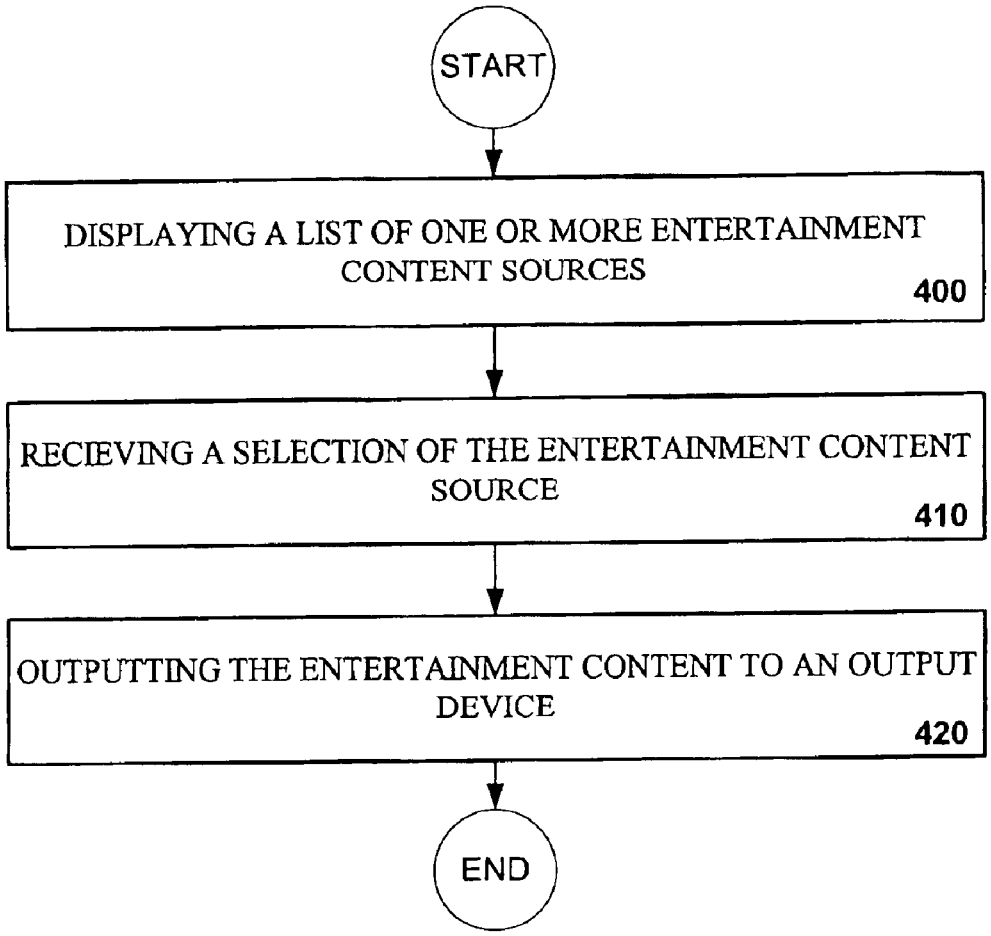
FIG. 4 is a flow chart depicting a method for providing entertainment content independent of the game outcome presentation on a gaming machine.

Turning now to FIG. 4, a flow chart depicts method for providing entertainment content independent of the game outcome presentation on a gaming machine. In 400, a list including at least one entertainment content source is displayed on an output device on the gaming machine. The entertainment content source may reside physically within the gaming machine or at a physical location separate from the gaming machine. In 410, the gaming machine receives a selection of the entertainment content source from the list displayed in 400. To access the entertainment content source, a player may have to deposit credits into the gaming machines or satisfy some other predetermined conditions before entertainment content from the entertainment content source is output from the gaming machine. Further, access to the entertainment content source may be independent of game play on the gaming machine. In 420, entertainment content from an entertainment source is output to an output device on the gaming machine. The output device may include a video display screen, audio projection device and the like residing on the gaming machine or a cell phone, pager and personal digital assistant separate from the gaming machine. The entertainment content from the entertainment content source may be accessed by the player while the player is involved with at least one game play on the gaming machine.

Figure 5:
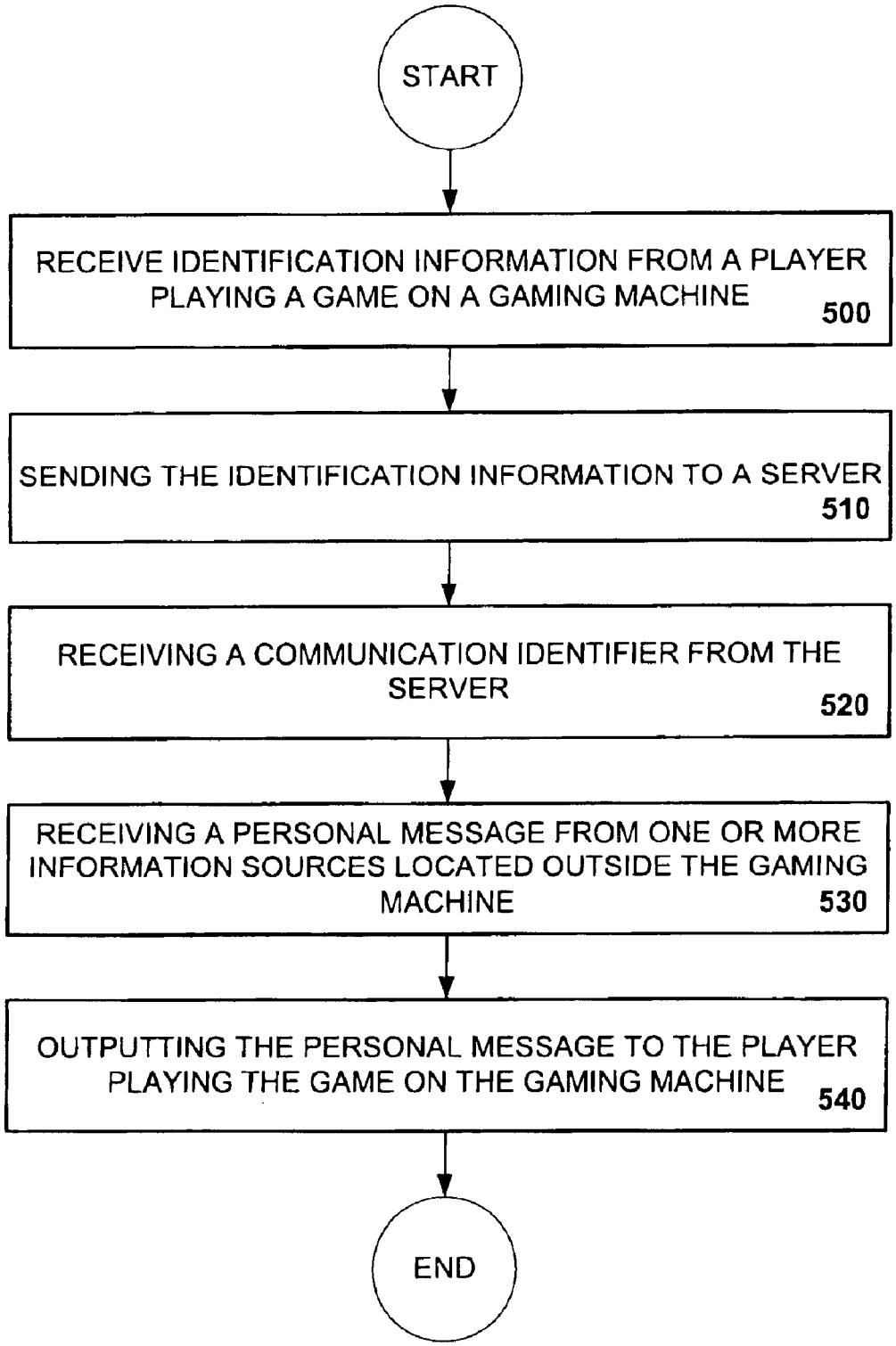
FIG. 5 is a flow chart depicting a method for sending a personal message to a player playing a game on the gaming machine.

FIG. 5 is a flow chart depicting a method for sending a personal message to a player playing a game on the gaming machine. In 500, the gaming machine receives identification information from the player playing the game on the gaming machine. The identification information may independent of player tracking information entered by the player. In 510, the identification information is sent to a server in communication with the gaming machine. In response to the communication from the gaming machine, the server assigns the gaming machine a communication identifier which may be an IP address when an Internet communication protocol is being used between the gaming machine and the server in 520. In 530, the server may act as a router of information between the gaming machine and some information source located outside the gaming machine. For example, a first player on a first gaming machine may send a second player on a second gaming machine a message. In 530, when the gaming machine receives a message, the message is sent to an output device on the gaming machine. For example, an e-mail message for the player may be sent to a video screen on the gaming machine for access by the player.

Figure 6:
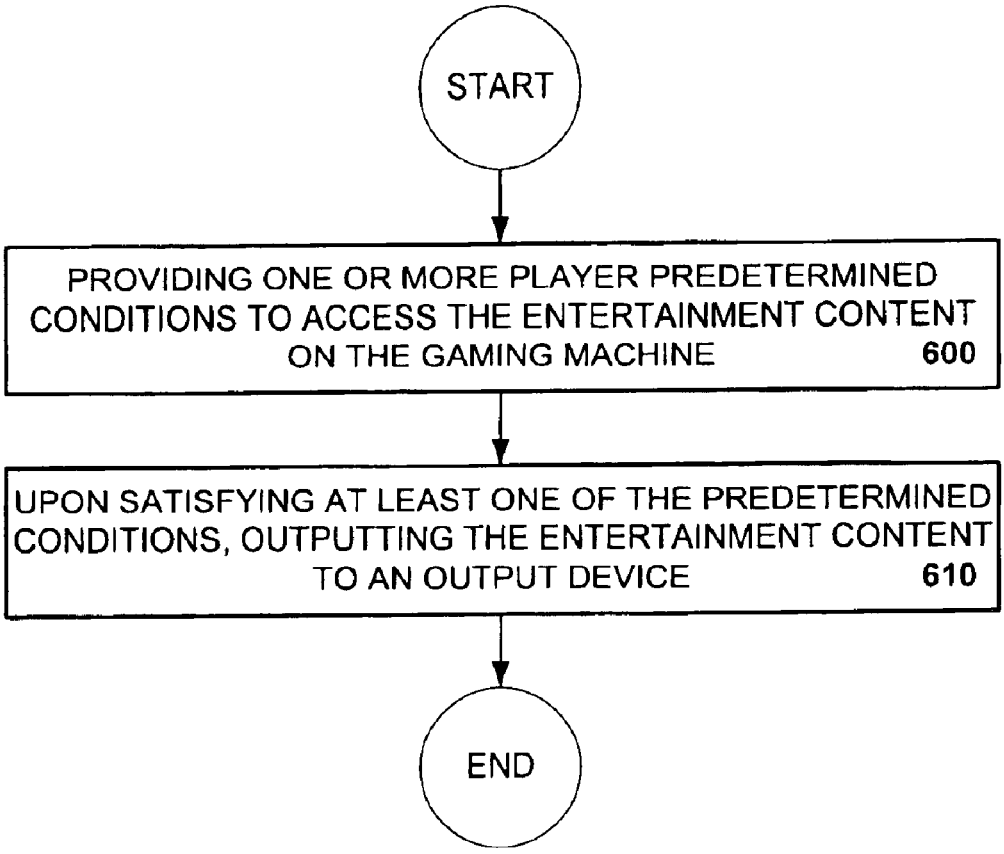
FIG. 6 is a flow chart depicting a method for enhancing player interest on a gaming machine by providing entertainment content.

FIG. 6 is a flow chart depicting a method for enhancing player interest on a gaming machine by providing entertainment content. The gaming machine may provide game outcome presentations and entertainment content where the entertainment content is independent of the game outcome presentation. In 600, one or more player predetermined conditions a player must satisfy to access the entertainment content on the gaming machine are presented to the player. As described above, a player predetermined condition may include actions such as depositing money into the gaming machine or making a wager on a game where the wager is above some threshold amount. In 610, when at least one of the predetermined conditions is satisfied, the entertainment content may be output to an output device.

Although the foregoing invention has been described in some detail for purposes of clarity of understanding, it will be apparent that certain changes and modifications may be practiced within the scope of the appended claims. For instance, while the gaming machines of this invention have been depicted as having top box mounted on top of the main gaming machine cabinet, the use of gaming devices in accordance with this invention is not so limited. For example, gaming machine may be provided without a top box.

What is claimed is:

1. A gaming machine comprising:

a video display device coupled to a main cabinet of the gaming machine;

a master gaming controller that controls one or more games played on the gaming machine and presents a game outcome presentation on said video display device;

at least one input device for selecting an entertainment content source; and at least one output device configured to output entertainment content from the selected entertainment content source, wherein one of the entertainment content sources is a locator service for allowing a person at the gaming machine to locate via the gaming machine a first person at a first gaming machine.

2. The gaming machine of claim 1, wherein the output device includes at least one of a sound projection device, a monitor, an LCD, a fluorescent display, a pair of headphones, or a head-mounted video display.

3. The gaming machine of claim 1, wherein the entertainment content source includes at least one of a CD player, an FM/AM tuner, a VHS player, a DVD player, a TV tuner, a musical jukebox, a video jukebox, a computer, a server, or a media software application.

4. The gaming machine claim 3, wherein the media software application is selected from a group consisting of an audio player, an image viewer, a movie player or a web browser.

5. The gaming machine of claim 1, wherein the input device includes at least one of a key pad, a touch screen, a mouse, a joystick and input button and a track ball.

6. The gaming machine of claim 1, wherein the entertainment content includes at least an advertisement, news, stock quotes, electronic mail, a web page, a message service, a locator service and a hotel/casino service, a movie, a musical selection or a broadcast event.

7. The gaming machine of claim 1, wherein the game includes at least a video slot game, a mechanical slot game, a pachinko gain, a video poker game or a keno game.

8. The gaming machine of claim 1, further comprising a first communication interface wherein the first communication interface allows the gaming machine to communicate with an entertainment content source located outside of the gaming machine.

9. The gaming machine of claim 8, further comprising a firewall that limits access to the gaming machine via the first communication interface.

10. The gaming machine of claim 1, wherein the entertainment content is initiated when a game play is initiated on the gaming machine.

11. The gaming machine of claim 1, wherein access to the entertainment content is time dependent upon an indicia of credit amount, a wager amount, or a game playing history.

12. The gaming machine of claim 1, wherein the entertainment content is provided according to a player information profile.

13. The gaming machine of claim 1, further comprising a second communication interface allowing the gaming machine to communicate with an output device located outside the gaming machine.

14. The gaming machine of claim 1, wherein the gaming machine is connected to an entertainment service network.

15. The gaming machine of claim 1, wherein the entertainment content can be accessed on the gaming machine without requiring a game of chance to be played prior to accessing the entertainment content.

16. The gaming machine of claim 1, wherein the entertainment content is displayed on the output device while the game outcome presentation is displayed on the video display device.

17. The gaming machine of claim 1, wherein the input device is used to control a feature of the entertainment content.

18. A method of providing entertainment content on a gaming machine with a video display device coupled to a main cabinet of the gaming machine for providing game outcome presentations for one or more games, the method comprising:

displaying a list of one or more entertainment content sources;

receiving a selection of the entertainment content source from said list;

outputting the entertainment content from the selected entertainment content source to at least one output device;

wherein one of the entertainment content sources is a locator service for allowing a person at the gaming machine to locate via the gaming machine a first person at a first gaming machine.

19. The method of claim 18, further comprising:

prior to outputting the entertainment content, determining an indicia of credit amount for the selected entertainment content source;

displaying a message on the display device notifying a player of the determined indicia of credit amount for the selected entertainment content source; and initiating the output of the selected entertainment content when the determined indicia of credit amount is available on the gaming machine.

20. The method of claim 19, wherein the determined indicia of credit amount is independent of a wager on a game play on the gaming machine.

21. The method of claim 18, further comprising prior to receiving the selection, receiving player tracking information; and allowing access to the entertainment content sources based upon the player tracking information.

22. The method of claim 18, further comprising:

deterring a total access time to the entertainment content source based upon player tracking information, a wager amount on a game or a indicia of credit amount deposited into the gaming machine;

comparing an access time to the entertainment source to the total access time; and terminating access to the entertainment content source when the access time exceeds the total access time.

23. The method of claim 18, further comprising:

prior to displaying the list of entertainment content sources, loading information describing the entertainment content available on the entertainment content sources.

24. The method of claim 18, further comprising:

displaying entertainment content on the output device while displaying the game outcome presentation on a display device.

25. The method of claim 24, wherein the output device is a first video display device and the display device is a second video display device.

26. The method of claim 18, further comprising:

receiving a second input signal to control a feature of the entertainment content source; and controlling said feature indicated in said second input signal.

27. The gaming machine of claim 18, wherein entertainment content at least include an advertisement, news, stock quotes, electronic mail, a web page, a message service, a locator service or a hotel/casino service, a movie, a musical selection and a broadcast event.

28. The gaming machine of claim 18, wherein the game is a video slot game, a mechanical slot game, a pachinko game, a video poker game or a keno game.

29. The method of claim 18, further comprising:

displaying a game outcome presentation for the one or more games wherein the entertainment content is provided during selected operational modes of the gaming machine.

30. The method of claim 18, further comprising:

splitting the video display into a plurality of windows;

displaying a game outcome presentation in a first window and displaying video-formatted entertainment content in a second window.

31. The method of claim 18, further comprising:

providing one or more player predetermined conditions a player must satisfy to access entertainment content on the gaming machine; and upon satisfying at least one of the predetermined conditions, outputting the entertainment content to an output device;

wherein the entertainment content can be accessed without requiring a game of chance to be played prior to accessing the entertainment content.

32. A gaming machine comprising:

a video display device coupled to a main cabinet of the gaming machine;

a master gaming controller that controls one or more games played on the gaming machine and presents a game outcome presentation on said video display device;

at least one input device for selecting an entertainment content source; and at least one output device configured to output entertainment content from the selected entertainment content source, wherein one of the entertainment content sources is a locator service for allowing a person at the gaming machine to locate via the gaming machine a first person at a first gaming machine and wherein one of the entertainment content sources is an electronic messaging service for allowing one or more of i) receiving via the gaming machine a first electronic message from the first person at the first gaming machine to the person at the gaming machine, ii) sending a second electronic message via the gaming machine to the first person at the first gaming machine from the person at the gaming machine or iii) combinations thereof.

33. A casino gaming system comprising:

a server in communications with a plurality of gaming machines wherein the server is operable i) to receive a request to locate a person at one of the plurality of gaming machines, ii) to determine a location of the person and iii) to route a message addressed to the person to the gaming machine where the person is located;

the plurality of gaming machines, each gaming machine comprising:

a display device coupled to a main cabinet of the gaming machine;

a master gaming controller that controls a game played on the gaming machine, presents a game outcome presentation for the game on said display device and receives the message addressed to the person;

an input mechanism for receiving cash or indicia of credit for a wager on the game, an output mechanism for outputting cash or indicia of credit;

an output device under control of the master gaming controller for transmitting the message to the person;

a local area network within a casino complex for allowing communications between the server and the plurality of gaming machines.

34. The casino gaming system of claim 33, wherein the message is a reminder of an upcoming event scheduled for the person at the casino complex.

35. The casino gaming system of claim 34, wherein the reminder is for a dinner reservation.

36. The casino gaming system of claim 33, wherein the message is in one of an audio format, a video format or combinations thereof.

37. The casino gaming system of claim 36, wherein the message is a voice message sent in a Voice-over-IP format.

38. The casino gaming system of claim 33, wherein the message is from a casino complex employee performing a service for the person.

39. The casino gaming system of claim 33, wherein the message is from a second person located a second gaming machine.

40. The casino gaming system of claim 33, wherein the output device is for outputting the message to one or more devices worn or carried by the person selected from the group consisting of a cell phone, personal digital assistant, head phones, a head-mounted video display, a pager.

41. The casino gaming system of claim 40, wherein the message is output via a wireless interface to the one or more devices worn or carried by the player.

42. The casino gaming system of claim 33, wherein the casino complex comprises:

one or more of a hotel or restaurants.

* * * * *